US006644467B1

(12) United States Patent
Chiuch

(10) Patent No.: US 6,644,467 B1
(45) Date of Patent: Nov. 11, 2003

(54) TRACK FOR DRAWING ASSEMBLY AND METHOD TO REMOVE THE RELATIVE GRIPPING ELEMENTS

(75) Inventor: Bruno Chiuch, S. Leonardo (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 0 days.

(21) Appl. No.: 10/069,133

(22) PCT Filed: May 18, 2000

(86) PCT No.: PCT/IB00/00668

§ 371 (c)(1),
(2), (4) Date: Feb. 22, 2002

(87) PCT Pub. No.: WO01/14076

PCT Pub. Date: Mar. 1, 2001

(30) Foreign Application Priority Data

Aug. 26, 1999 (IT) ..... UD99A0152

(51) Int. Cl.[7] ..... B65G 15/14

(52) U.S. Cl. ..... 198/867.15; 198/626.1; 198/867.01

(58) Field of Search ..... 198/604, 606, 198/626.1, 626.3, 626.5, 867.01, 867.15, 473.1, 470.1

(56) References Cited

U.S. PATENT DOCUMENTS

| | | | | |
|---|---|---|---|---|
| 2,251,291 A | | 8/1941 | Reichelt | |
| 2,679,924 A | | 6/1954 | Powell | |
| 4,798,281 A | * | 1/1989 | Egger | 198/626.5 X |
| 5,094,340 A | * | 3/1992 | Avakov | 198/626.1 |
| 5,988,364 A | * | 11/1999 | Boyce et al. | 198/867.15 |

FOREIGN PATENT DOCUMENTS

| | | |
|---|---|---|
| EP | 645200 | 3/1995 |

* cited by examiner

*Primary Examiner*—James R. Bidwell
(74) *Attorney, Agent, or Firm*—Stevens, Davis, Miller & Mosher, LLP

(57) ABSTRACT

Track for drawing assembly and method to replace the gripping elements associated with said tracks, wherein the track comprises a plurality of links able to support at least part of at least one gripping element of a product to be drawn, each of the gripping elements being able to be selectively clamped in a housing seating by means of rapid attachment/detachment means, said rapid attachment/detachment means comprising at least a clamping element axially movable along an axis substantially orthogonal to the plane on which said gripping element lies, and an activation element axially movable and able to displace said clamping element from a first clamping position to a second position wherein said gripping element is released.

25 Claims, 4 Drawing Sheets

TRACK FOR DRAWING ASSEMBLY AND METHOD TO REMOVE THE RELATIVE GRIPPING ELEMENTS

FIELD OF THE INVENTION

This invention concerns a track for drawing assemblies, used preferentially on drawing machines for metal products, such as bars or tubes, the drawing machines comprising two opposite and counter-rotating tracks suitable to achieve the axial drawing of said metal products.

The invention also concerns the connected method to remove and to replace the gripping elements associated with said tracks.

In the following description, to simplify the explanation, the metal products will be referred to under the general term of "bars", irrespective of the section thereof (round, square, polygonal, etc.) and of the fact that they are hollow or solid.

BACKGROUND OF THE INVENTION

The state of the art includes drawing machines for metal bars in which the drawing assembly comprises two tracks counter-rotating and opposite each other with respect to the drawing axis, each one consisting of a plurality of links on which pads are mounted to grip the bar to be drawn.

Each gripping pad has a hollow shaped to mate with the section of the bar in its already drawn segment. The two tracks are made to rotate continuously and, in co-operation with relative rigid guides, are suitable to clamp and draw the bar to achieve the drawing process.

The gripping pads can be removed from the respective links, so that they can be removed in the event of wear or if the section of the bar is changed.

The state of the art includes gripping pads which have two faces, a front and a rear face, inclined and suitable to cooperate with the walls of mating "dove-tailed" seatings made on the links of the track. The gripping pads are mounted by inserting them inside the relative "dove-tailed" seatings and they are subsequently clamped by means of rapid attachment/detachment means provided for this purpose and associated with the links of the track.

Generally speaking, the rapid attachment/detachment means consist of a pair of lateral clamps, associated with relative elastic means, suitable to clamp the sides of the gripping pads and prevent them from coming off.

In a condition of association with the links of the track, the gripping pads are therefore stably constrained inside the relative seating; they cannot be removed sideways due to the lateral clamps, nor lengthways because their faces and the inclined surfaces of the "dove-tailed" seating are coupled together through interference.

The gripping pads are released from the relative links by compressing the elastic means of the lateral clamps which in this way are released from the sides of the pads, and thus allow them to be extracted.

The arrangement of the lateral clamps and the reduced space available in proximity thereof means that the release operation is carried out manually, for the most part, possibly with the aid of appropriate tools.

This is necessary also to mount and clamp new gripping pads, making it practically impossible to automate the operations to replace the pads which are therefore very long and laborious, and entail a prolonged interruption of the production cycle and an increase in the overall costs of drawing.

The present Applicant has devised and embodied this invention to overcome these shortcomings and to obtain further advantages.

SUMMARY OF THE INVENTION

The invention is set forth and characterized in the respective main claims, while the dependent claims describe other characteristics of the invention.

The purpose of the invention is to achieve a track for the drawing assembly in drawing machines including rapid attachment/detachment means suitable to allow the operations to replace the gripping pads to be carried out quickly and easily, at the same time ensuring that the pads are stably and safely clamped to the relative links.

Another purpose of the invention is to allow the operations to replace the gripping pads of the tracks to be automated, so as to reduce to a minimum both the time taken to carry out these operations and also the manpower required.

In the track according to the invention each link comprises rapid attachment/detachment means suitable to selectively clamp the relative gripping pad in correspondence with a specific housing seating.

According to the invention, the rapid attachment/detachment means comprise a clamping element, arranged substantially orthogonal to the plane on which the track and the relative pad lie, and an activation element, or thruster element, arranged substantially transverse to said clamping element, and therefore substantially parallel to the plane on which the track lies, and cooperating therewith in constraining the pad.

The clamping element is constrained to the relative link so as to be able to move only in an axial direction.

In one embodiment of the invention, the clamping element has at least a segment comprising a cam profile, cooperating with a mating cam profile made on at least a segment of the thruster element.

In a first embodiment, the cam profiles consist respectively of a spherical or semi-spherical element solid with the clamping element and by a mating curved or semi-spherical portion of the surface made on the thruster element. According to another embodiment, the cam profiles consist of mating inclined planes.

The thruster element is arranged in a lateral position on the relative link, accessible laterally with respect thereto and is also axially movable, transversely to the axis of the clamping element, at least from a first retracted position to a second advanced position.

The axial movement of the thruster element, in a direction substantially parallel to the plane on which the track and pad lie, causes its cam profile to slide on the corresponding cam profile of the clamping element, in such a manner as to define the clamped/unclamped conditions of the gripping pad to/from the relative track.

To be more exact, with the thruster element in a first position, the clamping element partially emerges from the relative link, and inserts itself into a mating positioning and constraining seating made on the gripping pad, and causes the latter to be clamped.

The movement of the thruster element into a second position, on the contrary, causes the clamping element to be axially displaced and therefore released from said positioning and constraining seating, and then to be retracted to a position of non-interference with the gripping pad; in this condition, the gripping pad is released and therefore can be removed from the relative track.

By the axial movement alone of the thruster element, the invention therefore allows to clamp/unclamp each gripping pad, allowing the operations to replace the pads to be carried out easily and rapidly.

The arrangement and lateral accessibility of the thruster element on the relative link also allows to install, in a position of non-interference with the drawing assembly and with the two relative tracks opposite each other, an automatic drive device for the thruster element, and possibly automatic pick-up and positioning means for the assembly/dis-assembly of the gripping pads onto/from the tracks of the drawing assembly. This allows to accelerate the operations to replace the gripping pads and therefore to reduce the time that the production cycle of the drawing machine is interrupted.

BRIEF DESCRIPTION OF THE DRAWINGS

These and other characteristics of the invention will become clear from the following description of some preferential forms of embodiment, given as non-restrictive examples, with reference to the attached drawings wherein.

DETAILED DESCRIPTION OF PREFERRED EMBODIMENTS

Figure 1:
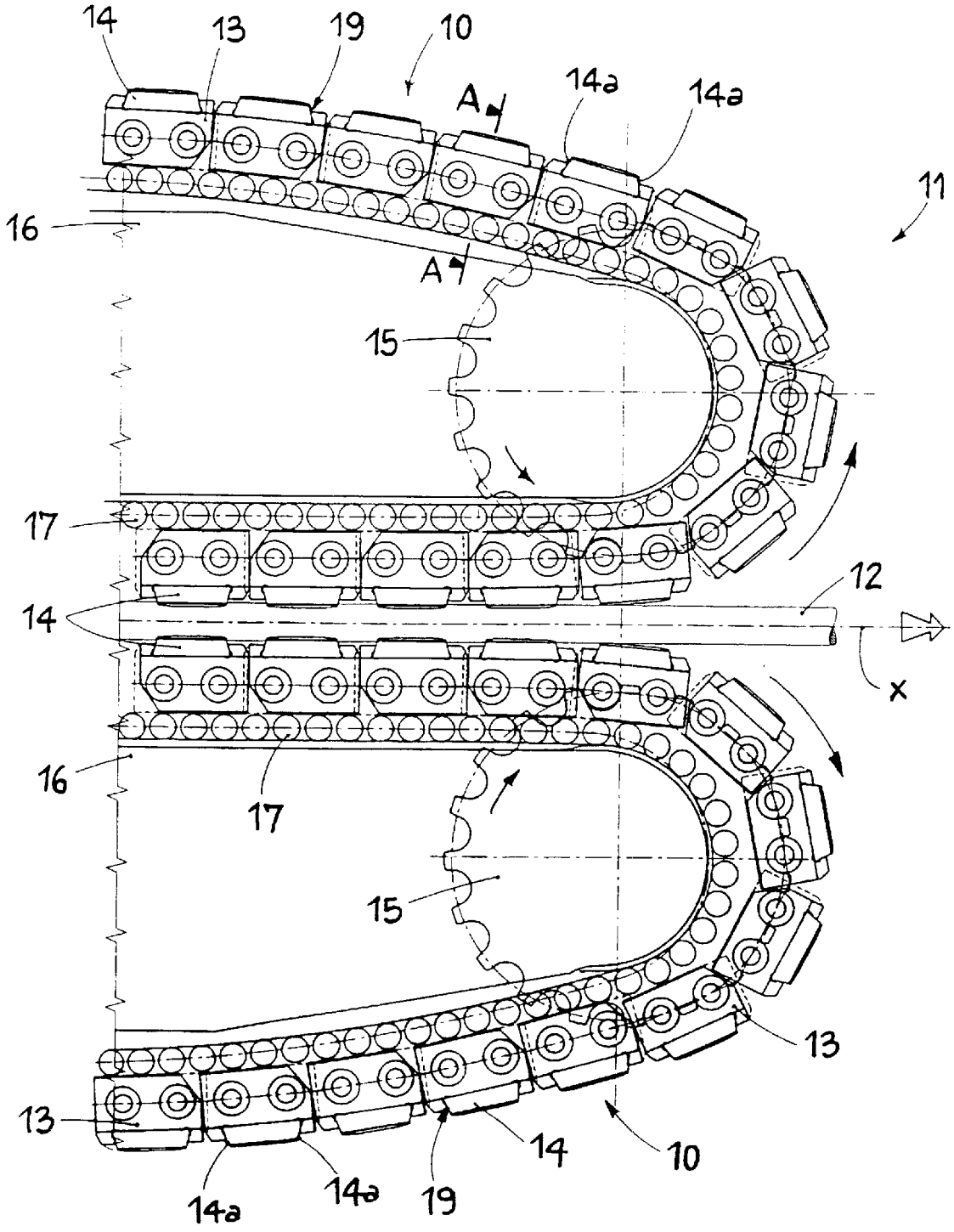
FIG. 1 is a part side view of a drawing assembly provided with tracks according to the invention.

With reference to the attached Figures, two tracks 10 according to the invention are part of a drawing assembly 11 of a conventional drawing machine for bars 12, which is not shown in the drawings in any greater detail. The two tracks 10, shown partly in FIG. 1, are symmetrical and opposite each other with respect to the drawing axis "x"; they are in counter-rotation with respect to each other, respectively above and below the drawing axis "x".

Each track 10 comprises a plurality of links 13 attached to each other by means of suitable articulated joints; on each link 13 a relative gripping pad 14 is mounted, and is selectively removable.

Every gripping pad 14 is provided at the upper part with longitudinal hollows 18 inside which the bars 12 are retained in correspondence with one segment thereof, to be drawn by the tracks 10 during the drawing process.

The two tracks 10 are mounted in a conventional manner on respective rigid supporting plates 16, they are made to rotate continuously by toothed wheels 15 on which they engage and exert a pressure on the bar 12 in cooperation with intermediate chains 17 of the roller type, imparting to the bar 12 a drawing action along the axis "x".

The two front faces 14*a*, respectively front and rear, of the pads 14 are inclined and convergent towards the outside and are arranged inside "dovetail-shaped" housing seatings 19 made transverse on the outer face of the respective links 13 and extending from one side to the other thereof.

The couplings between the front faces 14*a* and the mating inclined walls of the housing seating 19 cause each link 13 and the relative pad 14 to be constrained; this prevents both the accidental fall and the longitudinal extraction of the latter from the housing seating 19.

The gripping pads 14 can be released from the relative links 13, in order to be replaced, only by means of lateral extraction from the relative housing seatings 19.

According to the invention, this extraction is obtained by activating a rapid attachment/detachment organ 20, with which each link 13 is provided, comprising a central clamping element and a relative activation element; the organ 20 is suitable to clamp the relative gripping pad 14, in a stable and removable manner, inside the housing seating 19.

In the embodiment shown in FIGS. 2*a*, 2*b*, 3*a* and 3*b*, the organ 20 comprises a clamping pin 21, mounted to slide axially inside a cavity 23 made on the link 13 substantially orthogonally to the plane on which the pad 14 lies and communicating with the housing seating 19, and a thruster element 24 mounted laterally on the link 13 and located substantially orthogonal to the central pin 21.

On the face opposite that of the longitudinal hollow 18, and in a substantially central position, the gripping pad 14 is provided with a blind hole 28 axially aligned with the cavity 23 and suitable to receive the outer end of the central pin 21 to define the reciprocal clamping of the pad 14 and the link 13.

The central pin 21 is constrained at the lower part to a spring 22 which is also housed inside the cavity 23 and suitable to keep the pin 21 thrusting towards the outside and therefore in the direction of the blind hole 28. In a lateral, diametrically opposed position, the central pin 21, which in this embodiment consists of a little cylinder, has two inclined planes 21*a* facing towards the thruster element 24.

The thruster element 24 is housed to slide axially inside a transverse cavity 25, made through on the link 13 substantially parallel to the plane on which the pad 14 lies and orthogonally intersecting the cavity 23, from one side of which it partly protrudes.

The thruster element 24 is shaped like a fork and comprises two inclined plane extensions 24*a* which rest on the inclined planes 21*a* of the central pin 21, said inclined segments 24*a* and 21*a* defining respective cam profiles cooperating with each other.

The thruster element 24 is also provided with a through eyelet 24*b* communicating with a threaded hole 26*a* which intersects the transverse cavity 23 and is substantially parallel to the central pin 21.

A screw element 27 is inserted into the threaded hole 26*a* and is suitable to constrain the thruster element 24 to the link 13 and to define the axial sliding travel thereof inside the transverse cavity 23.

Figure 2A:
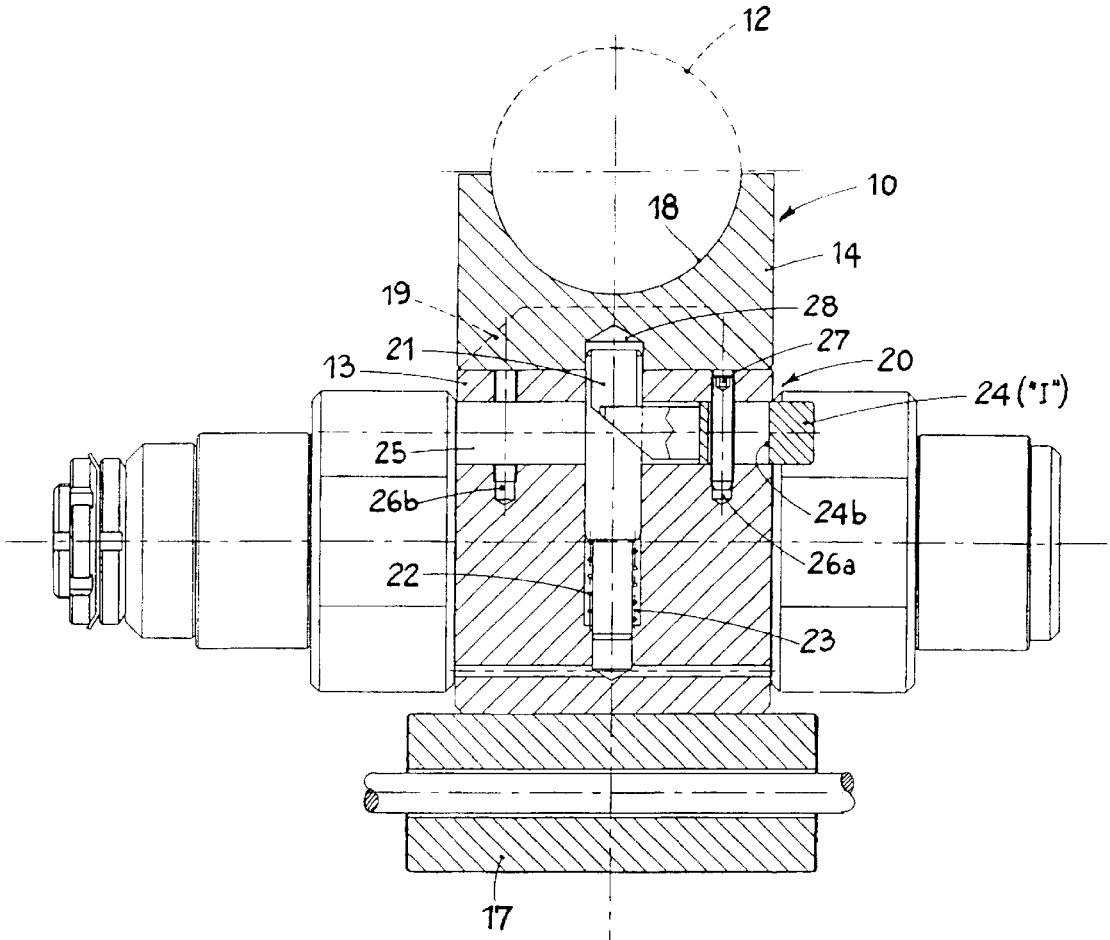
FIG. 2*a* shows the transverse section from A to A of FIG. 1 of a track in one embodiment of the invention with the gripping pad in the clamped condition.
Figure 2B:
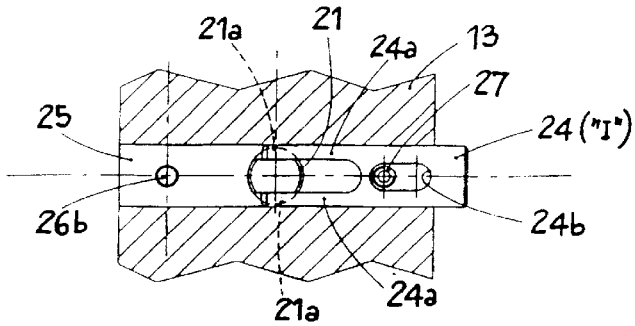
FIG. 2*b* is a partly sectioned view from above of a detail from FIG. 2*a;*
Figure 3A:
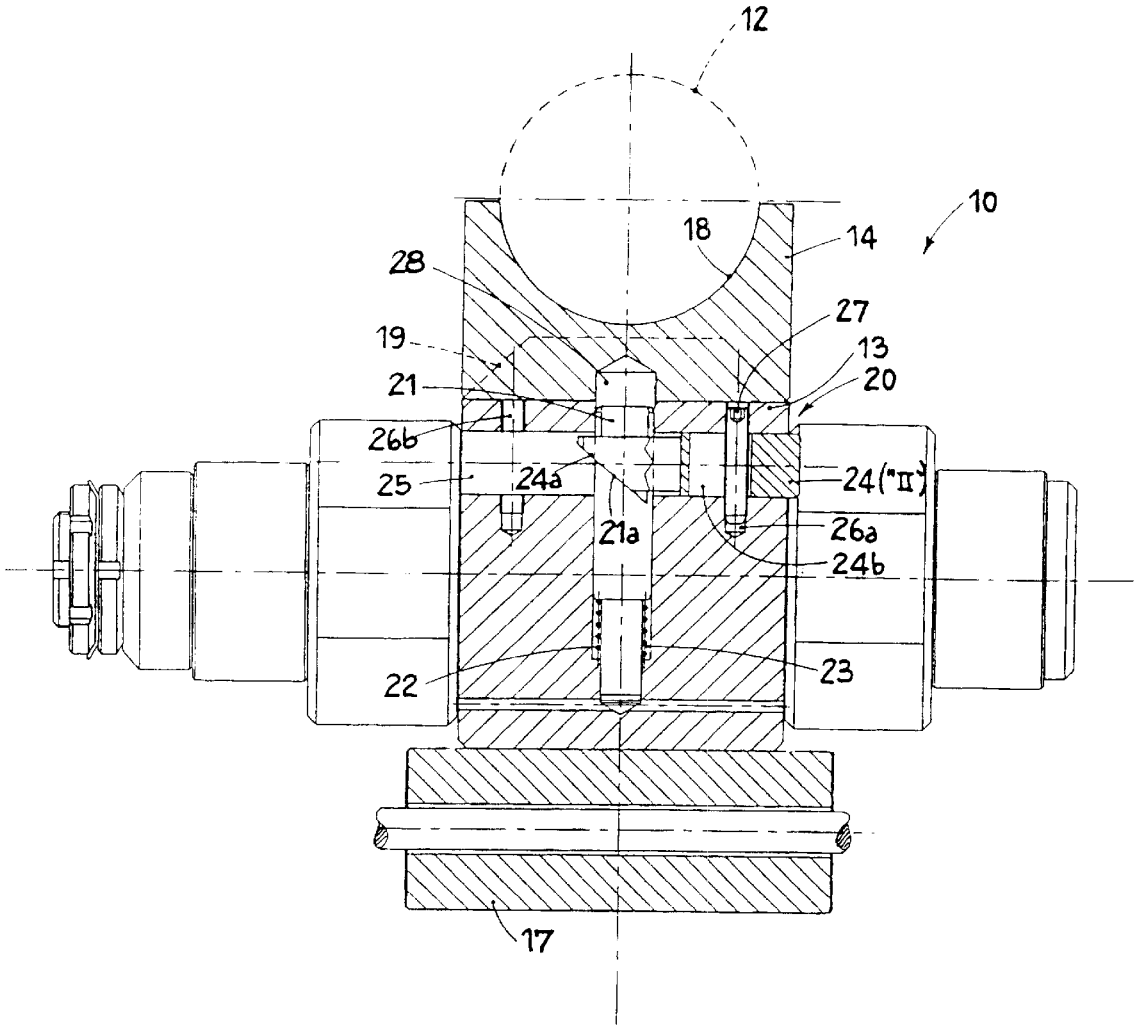
FIG. 3*a* shows the track from FIG. 2*a* with the gripping pad in the released condition.
Figure 3B:
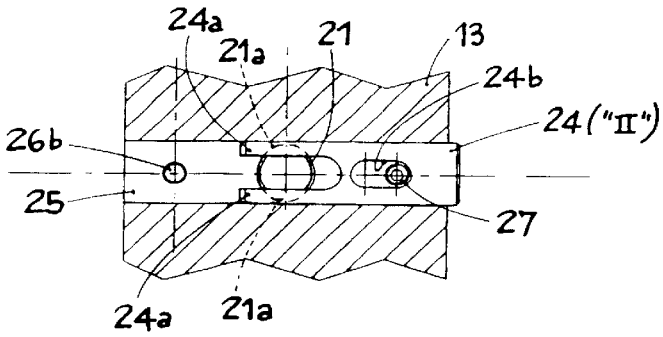
FIG. 3*b* is a partly sectioned view from above of a detail from FIG. 3*a;*

According to the invention, the thruster element 24 is movable from a first clamping position "I" (in this case retracted: FIGS. 2*a* and 2*b*), defined by the abutment of the inner end of the through eyelet 24*b* with the screw element 27, to a second release position "II" (in this case advanced: FIGS. 3*a* and 3*b*), defined by the abutment of the outer end of the through eyelet 24*b* with the screw element 27.

The first "I" and second "II" positions define respectively the conditions wherein the gripping pad 14 is clamped and released with respect to the relative link 13.

To be more exact, when the thruster element 24 is in its clamping position "I", the inclined plane extensions 24*a* rest on the lower part of the inclined planes 21*a* of the central pin 21, allowing the latter to rise and insert itself with its outer end inside the blind hole 28 due to the effect of the thrust of the spring 22. In this condition, the pin 21 stably clamps the gripping pad 14 with respect to the link 13.

As they take the thruster element 24 into the release position "II", the inclined plane extensions 24*a* slide on the inclined planes 21*a* of the central pin 21 and push it downwards, by compressing the spring 22, and cause the relative end to protrude from the blind hole 28. In this condition, the gripping pad 14 is released and can be removed by lateral extraction from the relative link 13.

The spring 22 tends to return the central pin 21 to the clamping position, once the pad 14 has been replaced, if necessary, and once the manual or automatic means which axially drive the thruster element 24 have been released.

Figure 4A:
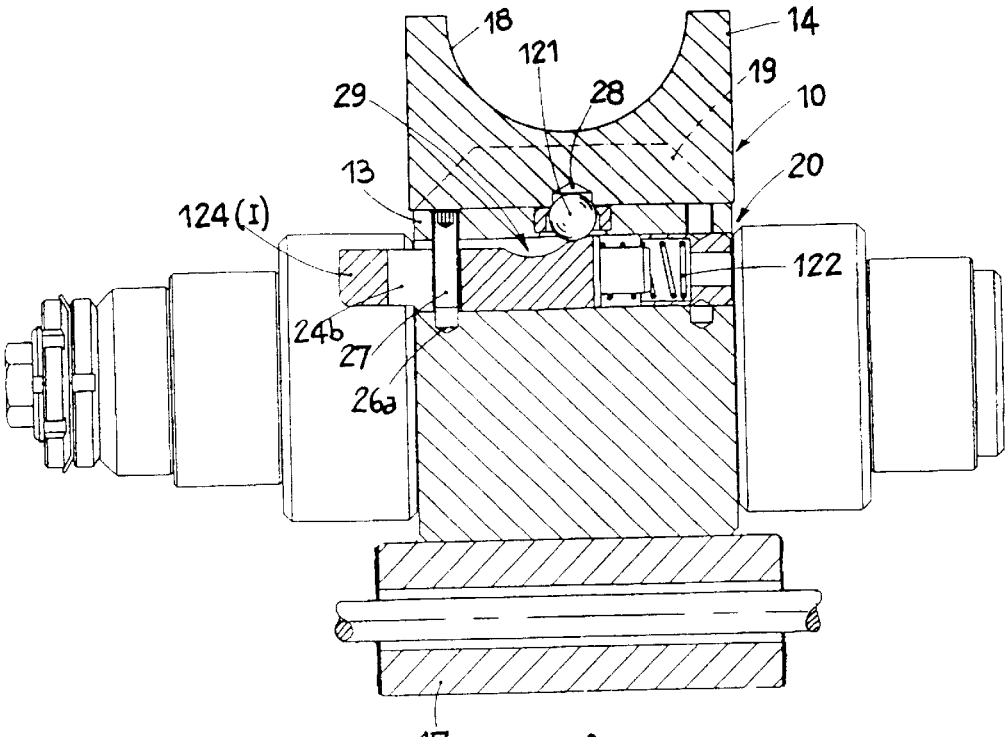
FIGS. 4*a* and 4*b* show another embodiment of the invention respectively in the clamped and unclamped position.
Figure 4B:
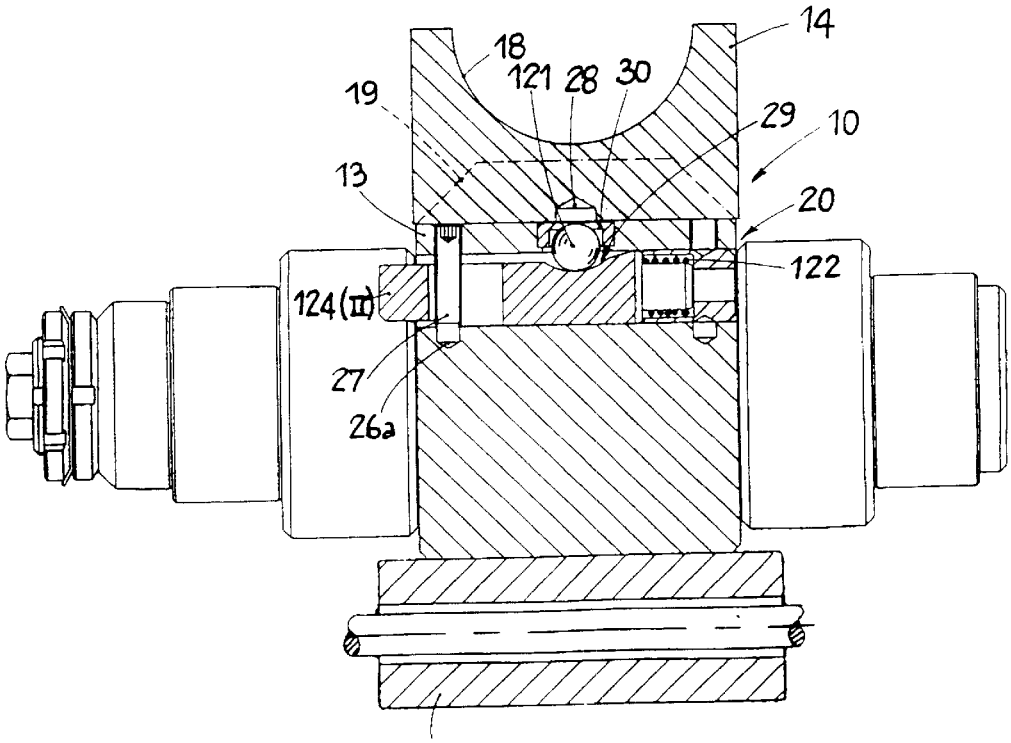

In the embodiment shown in FIGS. 4*a* and 4*b*, in which the same reference numbers have been given to those elements which are similar to, or which have the same function as, those in the embodiment shown above, the clamping element consists of a ball 121, while the activation element consists of a thruster element 124 associated at the rear with spring means 122.

In correspondence with an upper segment cooperating with the ball 121, the thruster element 124 has a cavity 29, substantially semi-spherical in shape, which acts as a cam profile to position the ball 121.

When the thruster element 124 is in its clamping position "I" (FIG. 4*a*), which in this case is its advanced position, the ball 121 cooperates with the upper edge of the cavity 29; in this way the ball 121, since it is contained laterally and unable to translate, is thrust towards the outside and is partly inserted inside the blind hole 28 made on the lower surface of the pad 14, thus clamping the pad 14 with respect to the link 13.

When the thruster element 124 is taken back to the release position "II" (FIG. 4*b*), which in this case is the retracted position, by compression of the spring means 122, the ball 121 is positioned inside the cavity 29, suitably sized; it is lowered and freed from the blind hole 28, and therefore releases the pad 14 which can be removed laterally with respect to the relative link 13.

Once the pad 14 has been replaced and the means to drive the thruster element 124 have been released, the spring means 122, like the spring means 22 in the embodiment shown in FIGS. 2*a*–3*b*, return the thruster element 124 automatically to the position "I" and thus to the position wherein the pad 14 is clamped.

In this case, the ball 121 is kept in position inside a conical housing seating 30 made on an insert 31 located in the outer part of the link 13 in direct cooperation with the blind hole 28 of the pad 14. The conical seating 30 causes the ball 121 to be precisely centered and positioned with respect to the cavity 29 provided on the thruster element 124 and hence guarantees the accuracy of the operations to clamp/unclamp the pad 14 with respect to the relative link 13.

Therefore, with this invention, we obtain that each pad 14 is clamped and unclamped simply by axially displacing the thruster element 24 in a direction substantially parallel to the plane on which the links 13 and pads 14 of the track 10 lie. This operation of axial displacement may be performed either manually, or automatically, by providing a suitable actuator device which can be arranged laterally to each track 10 and therefore in a position which does not interfere with the drawing assembly 11 with opposite tracks.

In this last case, the tracks 10 are made to rotate progressively so as to take all the links 13, one at a time, to a position corresponding to the actuator devices which can unclamp all the gripping pads 14 in sequence.

It is possible to remove the gripping pads 14 from the same side of the track 10 on which the thruster element 24 is arranged, or from the opposite side; it is also possible to remove the pads 14 automatically by a suitable manipulator device, which may also be suitable to insert new pads 14 into the housing seatings 19 of the links 13.

In this way the operations to replace the gripping pads 14 may be partly or completely automated according to the specific requirements connected to the production process. Once the pad 14 has been replaced, we have seen how the spring means 22 and 122 return the relative clamping means 21, 121 to their clamping position to clamp the new pad 14.

In the embodiment shown here, every link 13 also has, apart from the threaded hole 26*a*, a further threaded hole 26*b*, symmetrical to the first 26*a*, inside which the screw element 27 may, as an alternative, be screwed; this allows to associate the thruster element 24 on the opposite side of the link 13 should that be necessary or preferable for constructional and/or operative requirements.

In this case, the central pin 21 is mounted rotated by 180° to present its inclined planes 21*a* facing towards the thruster element 24.

It is obvious, however, that modifications and/or additions may be made to the track 10 as described heretofore, but these shall remain within the field and scope of this invention.

For example, the end of the central pin 21 may be shaped like a sphere, or the ball 121 may be associated with spring-type positioning means. Moreover, more than one clamping element may be provided for each pad 14, each one associated with a relative hole 28 made on the lower face of the pad 14 and suitable, for example, to be driven by the same drive element, or by different drive elements such as the thruster elements 24 and 124.

What is claimed is:

1. Track for drawing assembly, comprising a plurality of links able to support at least part of at least a gripping element, or pad of a product to be drawn, each of said gripping elements being able to be selectively clamped in a housing seating by means of rapid attachment/detachment means, wherein said rapid attachment/detachment means comprise at least a clamping element axially movable along an axis substantially orthogonal to the plane on which said gripping element lies, and an activation element axially movable and suitable to displace said clamping element from a first clamping position to a second position wherein said gripping element is released.

2. Track as in claim 1, wherein said activation element is suitable to move axially on a plane substantially parallel to the plane on which said gripping element lies.

3. Track as in claim 1, wherein in said first clamping position said clamping element cooperates with a seating made on the lower face of the relative gripping element.

4. Track as in claim 1, wherein in said second release position said clamping element is released from said seating.

5. Track as in claim 3, wherein said seating is a blind hole arranged axially with respect to said clamping element.

6. Track as in claim 1, wherein said clamping element is associated with elastic means suitable to maintain it in said first clamping position.

7. Track as in claim 1, wherein said activation element is associated with elastic means suitable to maintain it in a position wherein it maintains the clamping element in said first clamping position.

8. Track as in claim 1, wherein said clamping element has at least a segment comprising a cam profile cooperating with a mating cam profile made on at least one segment of said activation element.

9. Track as in claim 8, wherein said cam profile of said clamping element comprises a spherical or semi-spherical element suitable to be inserted at least partly inside said seating made on the lower face of the pad and said cam profile of the activation element comprises a cavity made on an upper segment cooperating with said spherical or semi-spherical element.

10. Track as in claim 8, wherein said cam profile of said clamping element comprises at least an inclined plane and said cam profile of said activation element comprises at least an inclined plane suitable to cooperate by sliding with said inclined plane to define said clamping and release positions of said clamping element.

11. Track as in claim 10, wherein said activation element has a fork-shaped segment comprising two inclined plane extensions cooperating with a pair of respective inclined planes of said clamping element.

12. Track as in claim 1, wherein said clamping element is movable axially inside a mating cavity made on said link and substantially aligned with said seating made on the lower face of the pad.

13. Track as in claim 1, wherein said activation element comprises a thruster element movable axially inside a seating made on said link and arranged substantially transverse to said cavity.

14. Track as in claim 1, wherein said activation element is mounted in a laterally accessible position on said link.

15. Track as in claim 1, wherein said link comprises constraining means and end-of-axial-travel means for said activation element.

16. Track as in claim 15, wherein said constraining and end-of-travel means comprise at least a screw element arranged inside a longitudinal eyelet of said activation element and attached inside a threaded hole intersecting with said transverse seating.

17. Track as in claim 1, wherein said activation element can be selectively associated in correspondence with both sides of said link.

18. Track as in claim 1, wherein said activation element can be associated with an automatic movement actuator device to automate the operations to replace said gripping pads.

19. Track as in claim 3, wherein in said second release position said clamping element is released from said seating.

20. Track as in claim 4, wherein said seating is a blind hole arranged axially with respect to said clamping element.

21. Track as in claim 12, wherein said activation element comprises a thruster element movable axially inside a seating made on said link and arranged substantially transverse to said cavity.

22. Method to remove a gripping element of a product to be drawn in a drawing assembly with tracks, each of said tracks comprising links able to support in a clamped position at least part of at least one of said gripping elements in a relative seating, the method comprising thrusting on at least one activation element, arranged in a lateral position on a relative link and at least partly accessible from one side thereof, to determine an axial displacement thereof in a direction substantially parallel to the plane on which said gripping element lies, the displacement of said activation element causing an action to release a relative clamping element which allows said gripping element to be removed from the relative seating.

23. Method as in claim 22, wherein said axial displacement of said activation element causes a mating axial displacement of the relative clamping element in a direction substantially orthogonal to the plane on which the relative gripping element lies, from a first outer clamping position to a second inner position wherein said gripping element is released.

24. Method as in claim 22, wherein the axial displacement of said activation element is performed manually or automatically by acting from a lateral position with respect to said tracks and not interfering therewith.

25. Method as in claim 23, wherein the axial displacement of said activation element is performed manually or automatically by acting from a lateral position with respect to said tracks and not interfering therewith.

* * * * *